United States Patent [19]

Dubuit

[11] 4,308,792

[45] Jan. 5, 1982

[54] DRUM PRINTING MACHINES HAVING DRIVE MEANS WITH FREEWHEEL AND CRANK-CONNECTING ROD SYSTEM

[75] Inventor: Jean-Louis Dubuit, Paris, France

[73] Assignee: Machines Dubuit Societe Anonyme, Paris, France

[21] Appl. No.: 51,126

[22] Filed: Jun. 22, 1979

[30] Foreign Application Priority Data

Jun. 26, 1978 [FR] France ..... 78 19034

[51] Int. Cl.[3] ..... B41F 17/22

[52] U.S. Cl. ..... 101/38 A; 101/126

[58] Field of Search ..... 101/38 A, 38 R, 39, 101/40, 126, 35; 192/45

[56] References Cited

U.S. PATENT DOCUMENTS

| | | | |
|---|---|---|---|
| 2,800,872 | 7/1957 | Remington et al. | 101/38 A X |
| 2,835,371 | 5/1958 | Davis | 101/38 A X |
| 3,104,744 | 9/1963 | Wade | 192/45 |
| 3,110,247 | 11/1963 | Simpson | 101/38 R |
| 4,092,447 | 5/1978 | Frederick et al. | 101/38 A X |

FOREIGN PATENT DOCUMENTS

| | | | |
|---|---|---|---|
| 1297842 | 5/1962 | France | 101/38 A |

*Primary Examiner*—Clifford D. Crowder

*Attorney, Agent, or Firm*—Charles E. Brown

[57] ABSTRACT

A printing machine is disclosed comprising a drum with a plurality of article holding mandrels. A feeding mechanism selectively feeds and positions article to be printed on the mandrels. An ejection mechanism automatically removes the printed articles from the mandrels. A drive effects stepwise annular displacement of the drum. A first actuating means effects reciprocating operation of the feeding mechanism and another actuating means effects reciprocating operation of the ejecting mechanism. Both the actuating mechanisms are controlled in synchronism with the drive and are independent and distinct from each other. The drive comprises a freewheel having an inner race fixed for rotation with the drum and a crank-connecting rod system attaching the outer race of the freewheel to a rotatably mounting driving shaft. Preferably the speed ratio of the actuating means of the feeding mechanism to that of the ejection mechanism is 2 to 1. The crank-connecting rod system comprises rods and cranks which are of adjustable length.

14 Claims, 9 Drawing Figures

DRUM PRINTING MACHINES HAVING DRIVE MEANS WITH FREEWHEEL AND CRANK-CONNECTING ROD SYSTEM

FIELD OF THE INVENTION

The present invention relates generally to printing presses or machines whether of the (silk) screen type or offset type.

BACKGROUND OF THE INVENTION

Such printing presses are of the kind comprising a drum rotatably mounted at a printing station and a plurality of article holding mandrels; a feed mechanism for automatically positioning articles to be printed on the mandrels, an ejection mechanism for automatically removing the printed articles from the mandrels; drive means for effecting stepwise angular displacement of the drum, actuating means for effecting reciprocating operation of the feed mechanism, and other actuating means for effecting reciprocating operation of the ejection mechanism. Both actuating means are controlled in synchronism with the drive means.

As the drum is displaced angularly stepwise the articles to be printed which are prepositioned on drum by the feed mechanism reach in succession the printing member, i.e. a (silk) screen or a blanket roller, before they are ejected by the ejection mechanism to a collector unit adapted, for example, to convey them to a dryer. All of the foregoing operations are automatic. Such a printing machine is disclosed in French Pat. No. 1,297,842 and has met with and continues to meet with satisfaction.

It does have its drawbacks. First of all, the drive means for stepwise angular displacement of the drum includes a Geneva wheel. As is known a Geneva wheel cooperates with a drive pin and is provided with a number of notches corresponding to the number of intervals into which each revolution is divided. Accordingly it comprises as many notches as there are article holding mandrels. As a result, the structure of such a Geneva wheel and that of the drum are related.

However, depending on the diameter of the articles to be printed it may be necessary for reasons of space to vary the number of mandrels per drum, that is, to reduce the number of mandrels as the diameter increases. In this case the drum must be replaced. However, for the following reasons the Geneva wheel must also be replaced or a suitable transmission must be provided between the Geneva wheel and the drum, which is relatively time-consuming and expensive.

Furthermore, in the machine described in the aforesaid French Pat. No. 1,297,842 the means for actuating the feed mechanism and the means for actuating the ejection mechanism have a common control so that their operating speeds are identical. Consequently, if the operating speed of the machine is to be augmented the operating speeds of the feed mechanism and the ejection mechanism are correspondingly increased at the same time.

Now, if the operating speed of the feed mechanism which handles the articles to be printed may often be increased without any problems this is not the case with the operating speed of the ejection mechanism which handles articles which have been inked and therefore must be handled with care to avoid smearing the printed image. If the operating speed of the ejection mechanism is too high, vibrations of the articles may occur which are liable to interfere with the transfer conditions to the conveyor means adapted to pick them up thereby smearing the printed image.

Therefore the operating speed of such presses must normally be limited accordingly.

SUMMARY OF THE INVENTION

It is an object of the present invention to overcome these drawbacks.

A more specific object of the invention is the provision of a printing machine of the above described type characterized, first of all, by drive means for effecting stepwise angular displacement to the drum comprising a freewheel having an inner race fixed for rotation with the shaft of the drum and an outer race attached to a rotatably mounted driving shaft through a crank-connecting rod system.

Such an arrangement advantageously lends itself to easy and quick adjustment of the feed increments of angular displacement of the drum per step, optionally after changing the drum: it suffices to adjust the length of any one of the cranks of the crank-connecting rod system.

In addition the incrementing of the drum may also be simply and quickly adjusted by varying the length of the connecting rod of crank-connecting rod system accordingly.

The printing machine according to the invention is further characterized by the actuating means of the feed mechanism being independent and distinct from the actuating means of the ejection mechanism. According to a preferred embodiment a speed ratio N of the actuating means for the feed mechanism relative to the actuating means for the ejection mechanism, is provided so that the ejection mechanism is adapted to operate simultaneously on N times more articles than the feed mechanism, N being for example equal to 2. Thus without reducing the operating rate of the machine the operating speed of the ejection mechanism is N times smaller than the operating speed of the feed mechanism whereby virtually all vibrations of the printed articles ejected are avoided.

In short the press embodying the present invention readily lends itself to different article diameters and provides a high printing rate.

These and other features and advantages will be brought out in the description which follows given by way of example, with reference to accompanying schematic drawings.

DETAILED DESCRIPTION OF THE PREFERRED EMBODIMENT

Figure 1:
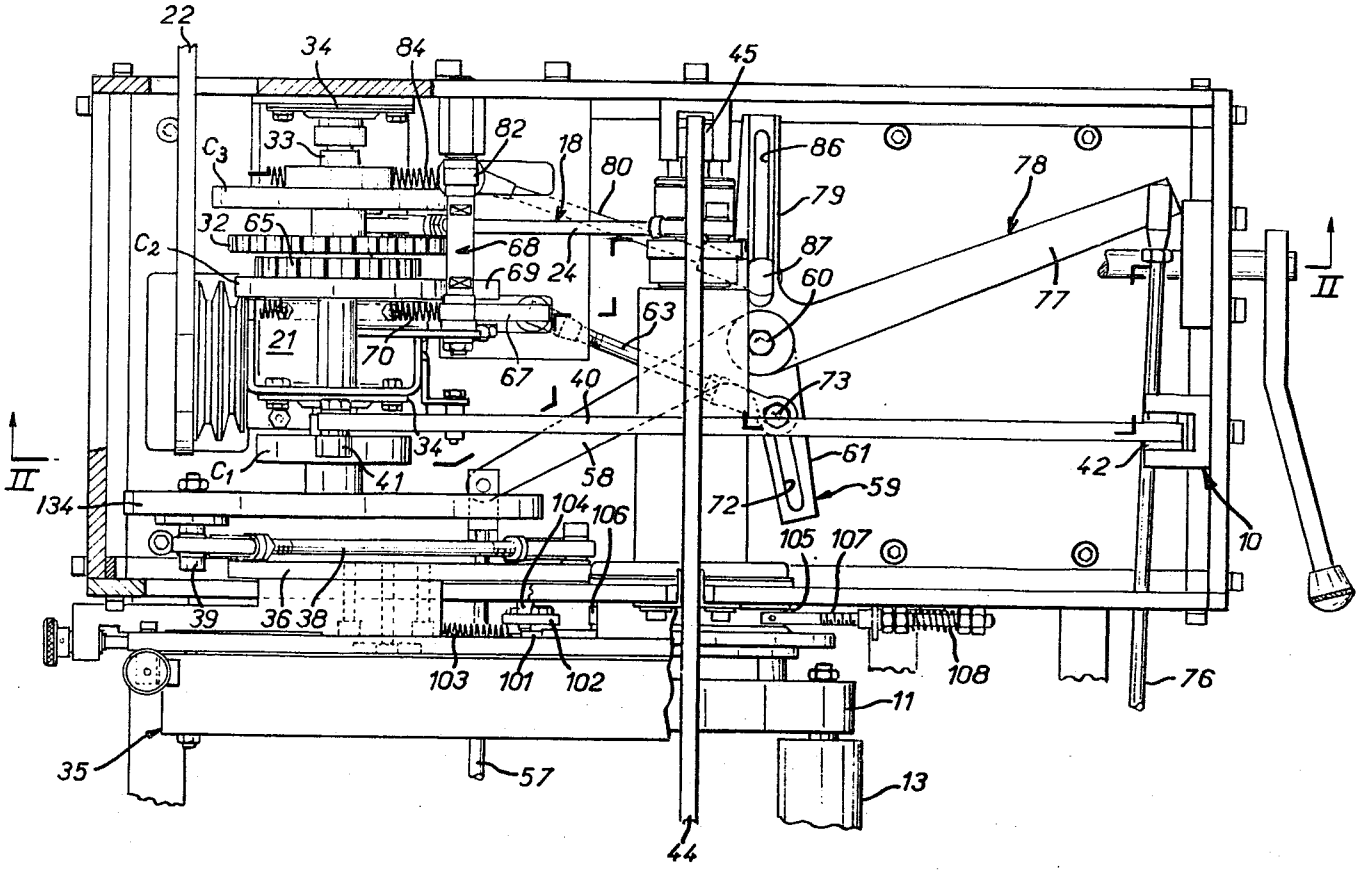
FIG. 1 is fragmentary view, partly broken away in several places, of a printing machine embodying the invention and more specifically the drive means of this press.
Figure 2:
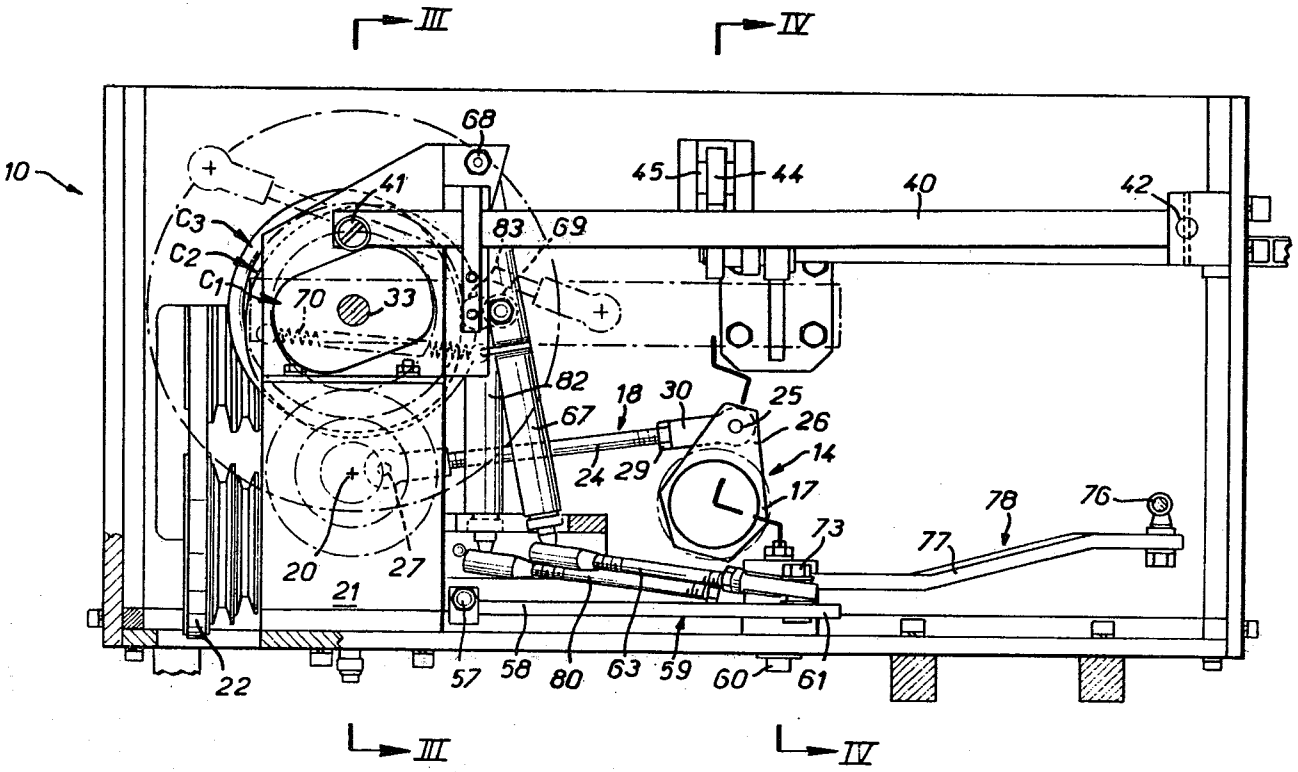
FIG. 2 is a fragmentary sectional elevational view taken on broken line II—II in FIG. 1.

The drawings illustrate, by way of example, the invention as applied to a (silk) screen printing machine. Such a printing machine has a fixed frame. General reference numeral 10 refers both to the component parts of the frame and the various parts carried by it.

The printing press comprises a drum 11 having a horizontal axis mounted for rotation at a printing station 12 and fitted with a plurality of article holding mandrels 13 in star array, eight in number in the illustrated embodiment and uniformly circularly spaced.

Figure 3:
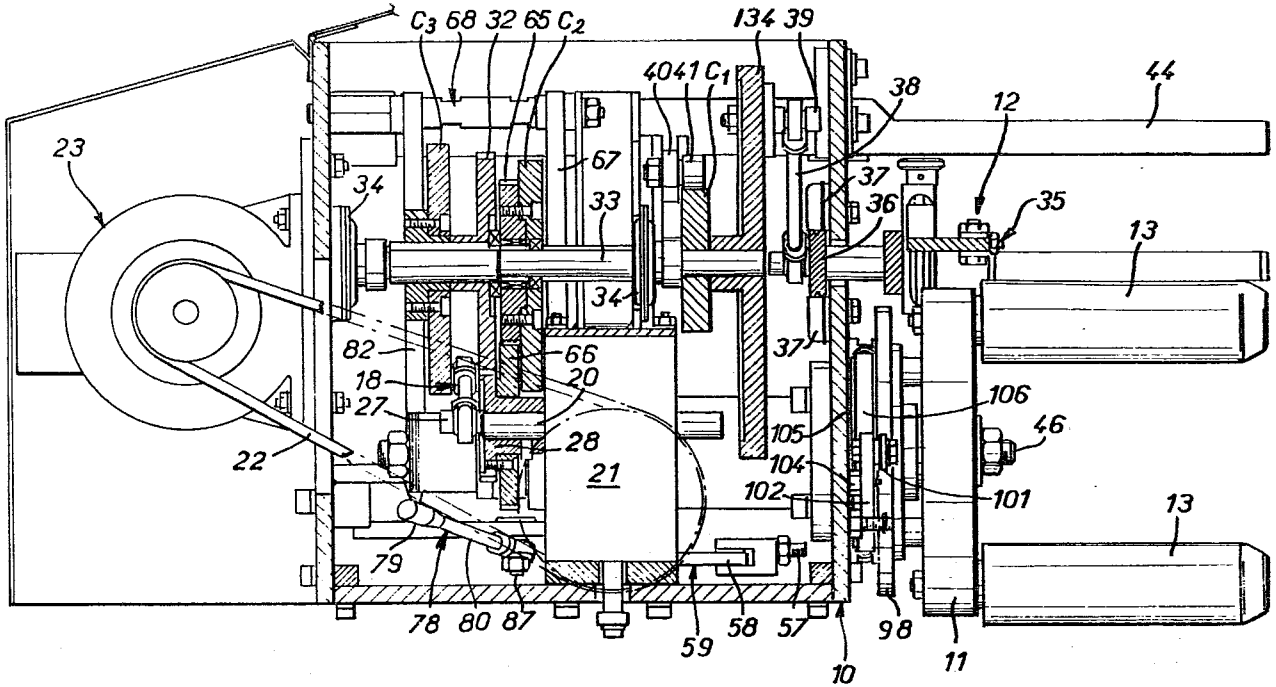
FIGS. 3 and 4 are cross-sectional views taken respectively on line III—III and broken line IV—IV in FIG. 2.

Drive means associated with the drum 11 are adapted to provide stepwise angular displacement. According to the invention the drive means comprise a freewheel 14 having an inner race 15 fixed for rotation with a shaft 16 carrying the drum 11 (FIG. 4) and an outer race 17 attached to a rotatably mounted driving shaft 20 (FIGS. 1 and 3) through a crank-connecting rod system 18. As illustrated, the driving shaft 20 is an output shaft of reducing gear 21 the input shaft of which is connected for rotation with a belt 22 on the output shaft of a motor 23 (FIG. 3).

The crank-connecting rod system 18 comprises a connecting rod 24 which is fastened at one end to a pin 25 carried by a lug 26 fixed to the outer race 17 of the freewheel 14 and thereby defining a crank, and which is fastened at its other end to a pin 27 carried by a gear 28 fixed to the driving shaft 20 and also defining a crank.

As is known per se, and hence will not be described in detail herein, one of the pins 25 and 27 is adjustably mounted on the part (or crank) carrying it, lug 26 or gear 28, radially thereof by, e.g. a mounting slot. Accordingly the crank comprised by the lug 26 or gear 28 is therefore adjustable in length.

Alternatively each pin 25, 27 or at least one of them is detachable, a plurality of holes being provided for the pin on the part (or crank) carrying it at different radial distances from the axis thereof.

In conjunction therewith the connecting rod 24 is of adjustable length and comprises a central shank or portion at least one end of which is in threaded engagement and held in place by a lock nut 29 in an end hub 30 attached to the corresponding pins 25, 27.

In the illustrated embodiment this arrangement concerns the end of the connecting rod 24 corresponding to pin 25 although it may as well concern the other end of the connecting rod.

Gear 28 meshes with gear 32 fixed for rotation on camshaft 33 extending parallel to and spaced from the drive shaft 20 between bearings 34 and beyond one of them. The camshaft 33, first of all, carries parts servicing the printing station 12.

The printing press comprises a plate or disc 134 defining a crank for reciprocating horizontal displacement of the corresponding (silk) screen as it is a (silk) screen printing press, and a cam $C_1$ for vertically reciprocating the squeegee typically associated with the (silk) screen. The (silk) screen and the squeegee are not shown in the drawings.

The frame 35 for carrying the (silk) screen is fixed to a bar 36 slidably mounted between two ball guideways 37 and fastened at one of its ends to a crank 39 whose other end is attached to a pin carried at an eccentric position on the disc 34. In conjunction therewith the lever 40 cooperates with the cam $C_1$ and is provided with a roller 41 at one of its ends and the other end is pivoted at 42 on the frame 10 of the printing press. A squeegee carrier 44 bears on the lever 40 and is pivoted at 45 on the printing press frame 10 and at its end opposite its squeegee receiving end.

The drum 11 is removably mounted at the end on shaft 16 by means of a nut 46 (FIG. 4) and therefore may be replaced by another such drum. Associated with the drum 11 is, first of all, an automatic feed mechanism which is adapted to position automatically the articles to be printed on the article holding mandrels 13 of the drum 11 and which is provided with actuating means for effecting reciprocating operation.

As illustrated, the feed mechanism comprises a feed table or slide 47 which is slightly inclined towards the article supporting mandrels 13 and comprised by a ramp 48 with two parallel lateral guides at least one of which is laterally adjustable with respect to the ramp, the ramps extending both ahead of its associated mandrel 13 and beyond it, and an upstanding cross member 50 is secured transversely at the lower end of the ramp 28 preferably adjustably relative thereto.

The feed mechanism also comprises a push rod 51 which is movably mounted crosswise with respect to the ramp 48 through a slot 52 defined therein in alignment with the associated mandrel 13. The push rod 51 which crosses the ramp is carried by a block 54 slidably mounted on two parallel guide bars 55 interconnected by an angle iron to a first link 63 reciprocated by a cam $C_2$. Cam $C_2$ is freely rotatably mounted about camshaft 33 and carried by gear 65 which in turn is freely rotatably mounted on the camshaft 33 and meshes with a gear 66 fixed to gear 28 which is fixed for rotation with the driving shaft 20.

A lever 67 pivotally mounted at one of its ends on a spindle 68 and attached at its other end to the link 63 has a follower roller 69 in engagement with cam $C_2$ and urged into contact therewith by spring 70.

At least one of links 57, 63 is provided with an adjustable position connection between it and the corresponding arm 58, 61 of the bellcrank lever 59. In the illustrated embodiment this arrangement is provided between link 63 and arm 61, the arm having a slot 72 receiving the corresponding end of the link 63 at any position in the slot and fixed in place by a nut and bolt fastener 73. In addition, in accordance with similar arrangements described above in detail with regard to the connecting rod 24, at least one of the links 57, 63, or preferably both, may be of adjustable length.

Figure 6:
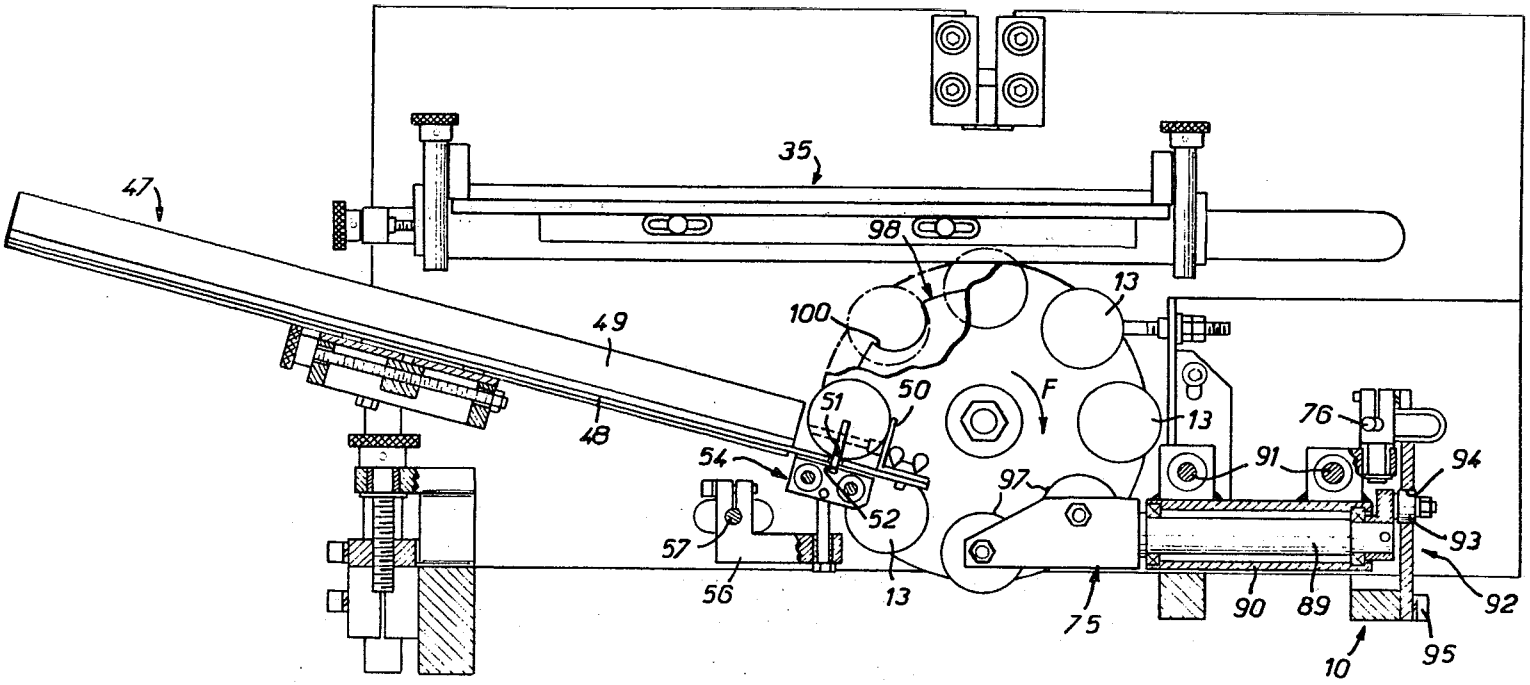
FIG. 6 is a corresponding elevational and sectional view taken on line VI—VI in FIG. 5.
Figure 8:
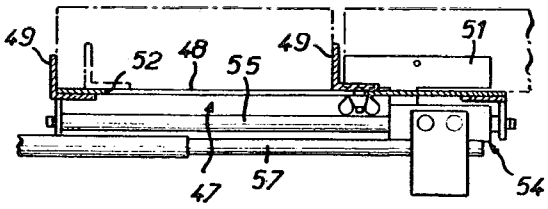
FIGS. 7 and 8 are detailed cross-sectional views taken respectively on line VII—VII and broken line VIII—VIII in FIG. 5.
Figure 7:
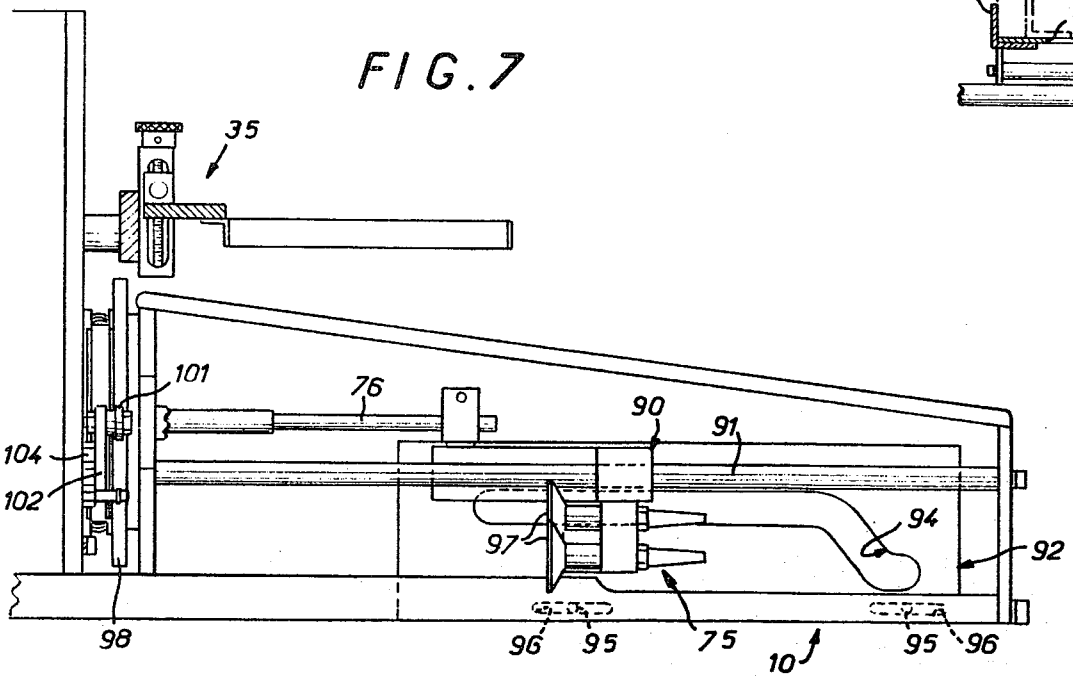
Figure 9:
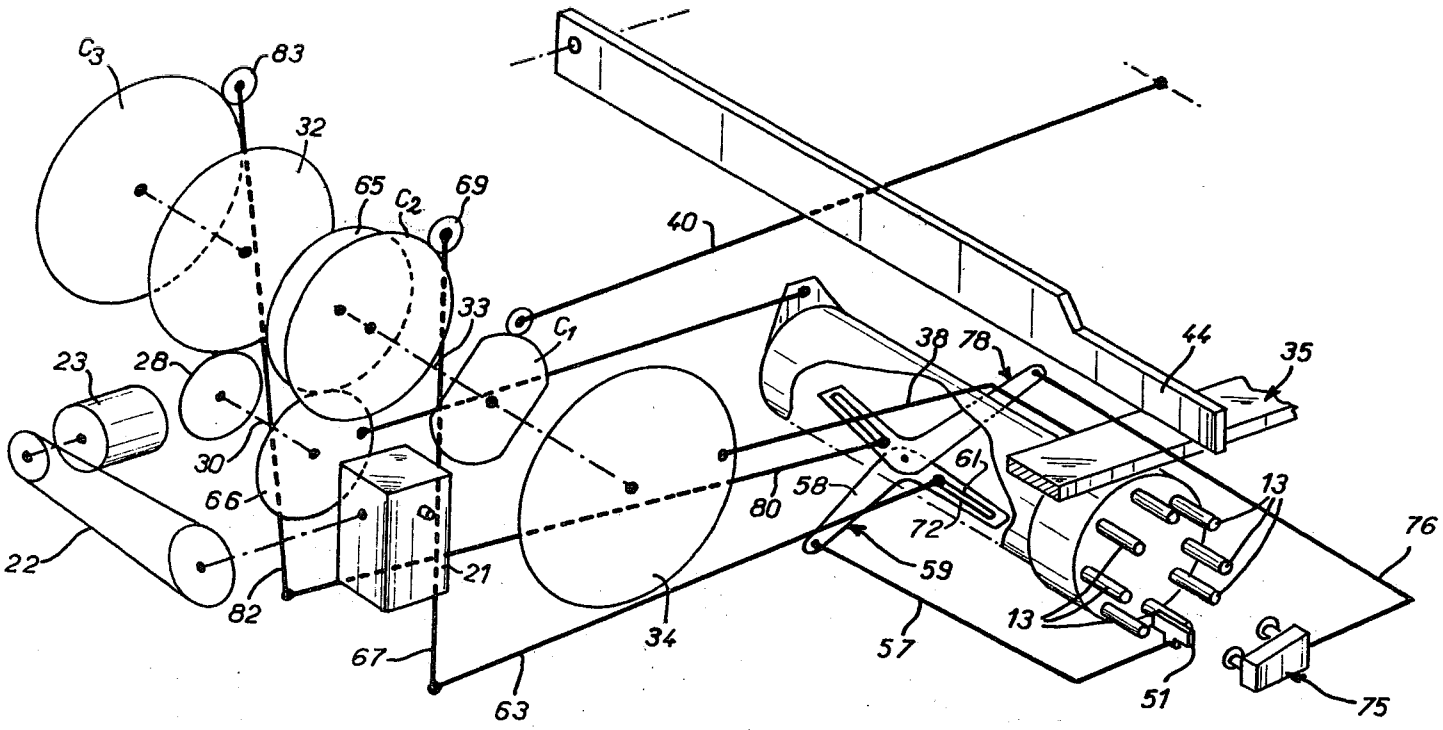
FIG. 9 is a diagram schematically illustrating the kinematics of the printing press or machine embodying the invention.

The mandrel 13 of the drum 11 corresponding to the feeding mechanism described above is obviously disposed ahead or upstream of the mandrel which is level with the screen carriage 35 relative to the direction of rotation of the drum 11 indicated by arrow F in FIG. 6.

Downstream or after the mandrel disposed level with the screen carriage is an ejection mechanism which is adapted to remove automatically the printed articles from the mandrels 13 and has actuating means for reciprocation in synchronism with the actuating means of the feed mechanism.

The ejection mechanism comprises an ejecting member 75 connected to a first link 76 (FIG. 5) which is attached to one of the arms of a bellcrank lever 78 fulcrumed 60 at the intersection of its arms, the other arm 79 is attached to a second link 80 which is subjected to reciprocating movement by a cam $C_3$ (FIG. 1). This cam is fixed directly on camshaft 33.

Hence according to the invention the actuating means of the feed mechanism comprising cam $C_2$, link 63, bellcrank lever 59 and link 57 are independent and distinct of the actuating means of the ejection mechanism comprising cam $C_3$, link 80, bellcrank lever 78 and link 76.

Features similar to those described with respect to the feed mechanism are also adopted here in the ejection mechanism. The link 80 is attached to one of the ends of a lever 82 which is pivoted at its other end on spindle 68 and bears through follower roller 83 against cam $C_3$ resiliently urged in contact therewith by a spring 84. At least one of links 76, 80, and in practice and as shown at least link 80, has an adjustable position connection provided between link 80 and arm 79 corresponding to bellcrank lever 77. For this purpose the arm 79 is provided with a slot 86 through which the link 80 is fastened by a nut and bolt fastener 87. At least one of the links 76, 80 is of adjustable length.

In practice, as shown, the ejecting member 75 is carried at the end of a shaft 89 rotatably mounted in a support block 90 which, in turn, is slidably mounted on two parallel horizontal guides and is attached to the link 76 (FIG. 6). In order to control the angular orientation relative to the block 90 a guide plate 92 is associated with the ejecting member 75. A lug and slot type of interconnection is provided between the ejecting member 75 and the guide plate 92. In practice, as shown, shaft 89 carrying ejecting member 75 carries such a lug 93 at its other end and the lug which carries a roller is received in a slot 94 in the guide plate 91. The guide plate is secured by screws 95 to frame 10 of the printing press and therefore is removable and replaceable with another such guide plate. Further, the guide plate is adjustable in position relative to the frame 10, the through holes 96 for screws 95 are elongated and form slots.

In the illustrated embodiment the ejecting member 75 is adapted to act simultaneously on two articles whereas the push rod 51 acts on only one article. Correspondingly the gears 28, 32, 65 and 66 define a 2 to 1 speed ratio between cams $C_2$ and $C_3$. However, more generally, a speed ratio N may be provided between the actuating means of the feed mechanism and the actuating means of the ejection mechanism, and therefore the ejecting member is adapted to act each time on N times as many articles as the feed mechanism.

In the illustrated embodiment since the ejecting member is adapted to act on two articles at the same time it is equipped with two suction nozzles 97.

According to arrangements which are known per se and will therefore not be described in detail herein, these suction nozzles are adapted to be connected to aspirator means under the control of control means adapted to alternately make and break the connection with the aspirator means in synchronism with the operation of the printing machine.

Figure 4:
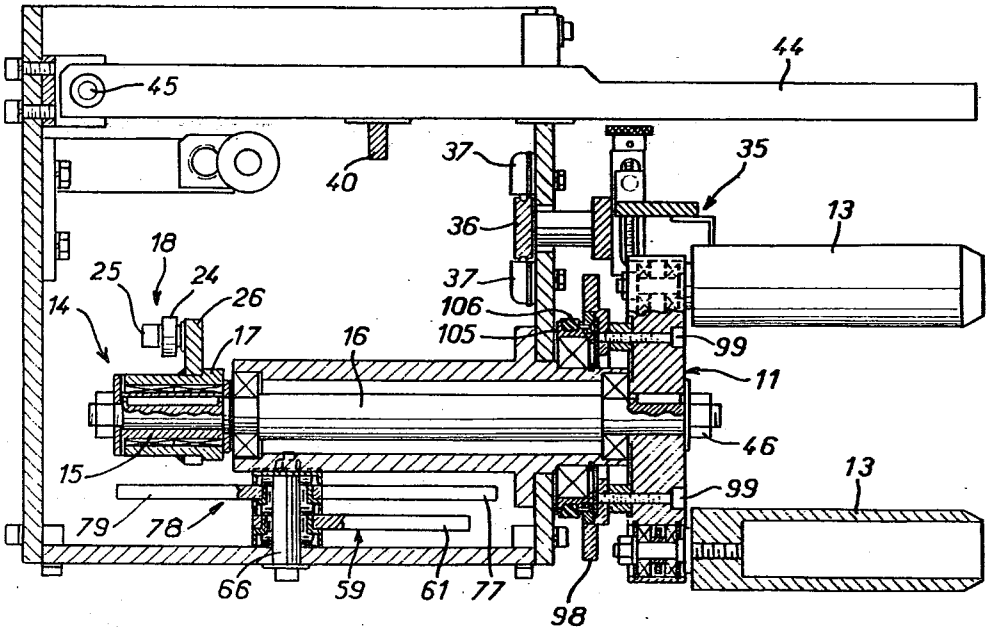
Figure 5:
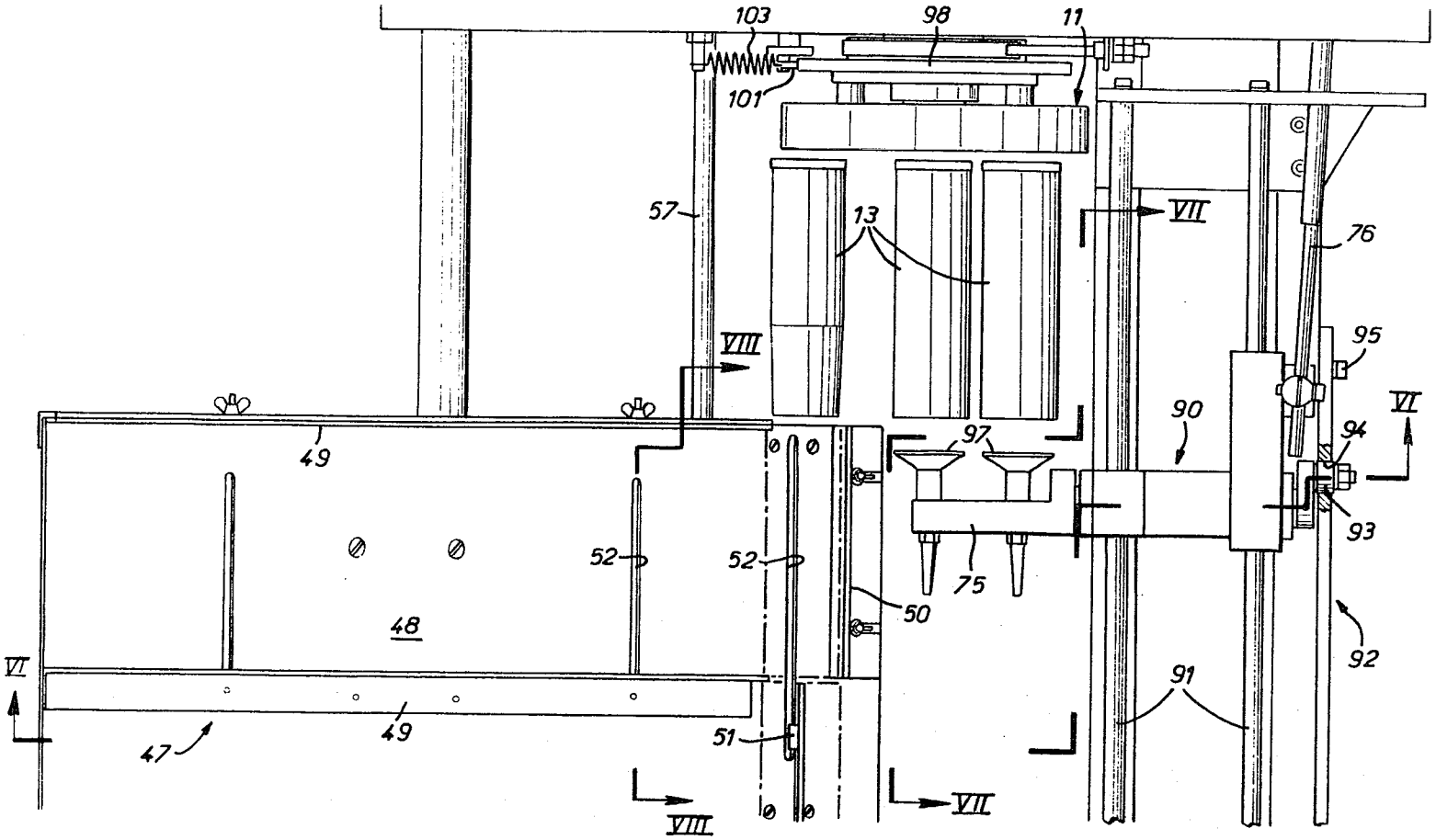
FIG. 5 is another fragmentary plan view of the printing press embodying the present invention, and particularly the feed mechanism and ejection mechanism thereof.

Finally, associated with the drum 11 is holding means adapted to determine positively the angular position of the drum following each successive advance. The holding means comprises a circular plate 98 fixed by screws 99 to drum 11 and provided along its peripheral edge with a number of notches 100 equal to the number of mandrels 13 on the drum 11 (FIGS. 4–6). Cooperating with these notches 100 is follower 101 carried at an end of lever 102 pivotally mounted at 104 and urged by spring 103 constantly towards the peripheral edge of the plate member 98. Further, to the plate member 98 is fixed a grooved pulley 105 over which is reeved a U-shaped brake band 106 the ends of which are secured to tie bolts 107 bearing on the frame 10 of the machine, a tensioning spring 108 being provided for at least one of the tie bolts 107.

The articles to be printed, e.g. simple tubes, are arranged crosswise on the feed table or slide 47 and then roll down the ramp 48 in pairs in contact with each other. The article at the bottom of the corresponding lane is held back by the cross member 50 in line with a support mandrel 13. The push rod 51 automatically introduces the article on this mandrel and as soon as the push rod 51 is retracted another article takes its place against the cross member 50.

The drum advances stepwise in the direction of arrow F; each revolution of the driving shaft 20 effects through freewheel 14 a fraction of a revolution of the drum and the mandrels receive one after another an article to be printed. When such an article comes into vertical alignment with the screen carriage 35 a printed image is applied thereto by a known method, the turning of the article which may be necessary for applying the image being insured by its contact with the screen carried by the carriage.

When the printed articles come into line with the ejecting member 75 they are removed in pairs from their corresponding mandrels and upon reaching the end of the ejecting stroke of the ejecting member 75 the latter is swung downwards in the illustrated embodiment by the corresponding end of the slot 84 in guide plate 92.

The ejecting member 75 then releases the articles it has ejected and they fall to vertical fingers carried on a discharge conveyor for example, to a drying or discharge station.

All these steps which are controlled by one and the same drive shaft are performed in synchronism, the various cams being brought to the requisite relative positions with respect to one another.

Advantageously the ejection mechanism operates at half the speed of the feed mechanism.

In order to adapt the machine to articles of different lengths, it is sufficient to adjust the lateral guides of the feed table 47 accordingly and adjust the stroke of the push rod and the ejecting member 75 sufficiently by effecting the slotted coupling connection between one of the arms of the corresponding bellcrank lever and the link attached to this arm, coupled with changing the length of this link if necessary.

Likewise, the machine may easily be adapted to drums carrying a different number of mandrels 13. For this, it suffices first to remove the drum and its plate member and substitute therefor another drum with the desired number of mandrels and a plate member or disc adapted thereto. Then it is simply necessary to adjust the length of at least one of the cranks of the crank-connecting rod system 18 to adapt the length of the advance increment of the new drum to the number of mandrels thereon.

In any event the incremental movement of the drum relative to the driving shaft 30 and therefore relative to cams $C_1$, $C_2$ and $C_3$ is performed together with the adjustment of length of the connecting rod 24 accordingly.

In case the articles to be printed are to be freed horizontally by the ejecting member 75 without bringing it to an upstanding position beforehand, the conveyor is provided with horizontal cradles instead of vertical fingers for receiving the printed articles. It suffices to remove the guide plate 92 and substitute therefor a new guide plate having a straightline slot 94. In any event the guide plate is easily adjusted in longitudinal position by its fastening slots 96.

The present printing machine is therefore highly versatile and adapts well to various types of use.

The present invention is moreover not limited to the embodiment of the invention described and illustrated herein but on the contrary it encompasses, without departing from the spirit and scope of the invention as defined by the appended claims, all modifications, variations and alternatives which will be apparent to those skilled in the art.

In particular the printing machine need not have simple inclined feed table or slide. Rather, articles may be fed by a conveyor such as the one disclosed in the above mentioned French Pat. No. 1,297,842.

Lastly the use of the invention is not limited to (silk) screen printing machines but on the contrary is intended to include other types of printing machines and presses, namely offset printing machines.

What is claimed:

1. In printing machine of the type comprising a drum carried by a rotatable shaft at a printing station and provided with a plurality of article holding mandrels, a feeding mechanism for selectively feeding and positioning articles to be printed on said mandrels, an ejection mechanism for automatically removing printed articles from said mandrels, drive means for effecting stepwise angular displacement of said drum, actuating means for effecting reciprocating operation of said feeding mechanism, and actuating means for effecting reciprocating operation of said ejection mechanism, both of said actuating means being controlled in synchronism with said drive means, the improvement comprising said drive means including a freewheel having an inner race fixed for rotation with said drum and an outer race, a crank-connecting rod system attaching said outer race to a rotatably mounted driving shaft, and means for positively determining the angular position of the drum comprising an indexing member fixed to the drum and brake means coacting with means fixed relative to said drum.

2. The improvement to claim 1, wherein said crank-connecting rod system includes plural connecting rods at least one of which is of adjustable length for adjustment of feed increments.

3. The improvement according to claim 1, wherein said crank-connecting rod system includes a crank which is of adjustable length.

4. The improvement according to claim 1, wherein said drum together with said indexing member is interchangeably removably mounted on its rotatable shaft.

5. The improvement according to claim 1, wherein said actuating means for said feeding mechanism is independent and distinct from said actuating means for said ejection mechanism, and wherein said actuating means are constructed and arranged to have different rates of speed.

6. The improvement according to claim 5, the speed ratio N of said actuating means for said feeding mechanism relative to said actuating means for said ejection mechanism being such that said ejection mechanism ejects twice as many articles as said feed mechanism feeds to said drum at a time.

7. In printing machine of the type comprising a drum carried by a rotatable shaft at a printing station and provided with a plurality of article holding mandrels, a feeding mechanism for selectively feeding and positioning articles to be printed on said mandrels, an ejection mechanism for automatically removing printed articles from said mandrels, drive means for effecting stepwise angular displacement of said drum, actuating means for effecting reciprocating operation of said feeding mechanism, and actuating means for effecting reciprocating operation of said ejection mechanism both said actuating means being controlled in synchronism with said drive means, the improvement comprising said drive means including a freewheel having an inner race fixed for rotation with said drum and an outer race, a crank-connecting rod system attaching said outer race to a rotatably mounted driving shaft, said actuating means for said feeding mechanism being independent and distinct from said actuating means for said ejection mechanism, said feeding mechanism comprising a push rod connected to a first link attached to one of the arms of a bellcrank lever fulcrumed at the intersection of its arms, and the other arm of said bellcrank lever being attached to a second link reciprocated by a cam, characterized by an adjustable position connection between one of said links and the associated arm of said bellcrank lever whereby the stroke of said push rod is adjustable by adjustment of the position connection.

8. In printing machine of the type comprising a drum carried by a rotatable shaft at a printing station and provided with a plurality of article holding mandrels, a feeding mechanism for selectively feeding and positioning articles to be printed on said mandrels, an ejection mechanism for automatically removing printed articles from said mandrels, drive means for effecting stepwise angular displacement of said drum, actuating means for effecting reciprocating operation of said feeding mechanism, and actuating means for effecting reciprocating operation of said ejection mechanism, both said actuating means being controlled in synchronism with said drive means, the improvement comprising said drive means including a freewheel having an inner race fixed for rotation with said drum and an outer race, and a crank-connecting rod system attaching said outer race to a rotatably mounting driving shaft, said feed mechanism comprising a push rod connected to a first link attached to one of the arms of a bellcrank lever fulcrumed at the intersection of its arms, and the other arm of said bellcrank lever being attached to a second link reciprocated by a cam, characterized by an adjustable position connection between one of said links and the associated arm of said bellcrank lever whereby the stroke of said push rod is adjustable by adjustment of the position connection.

9. The improvement according to claim 8, wherein at least one said link is adjustable lengthwise.

10. The improvement according to claim 8, said ejection mechanism comprising an ejecting member connected to a first link attached to one of the arms of a bellcrank lever which is fulcrumed at the intersection of its arms, the other arm of said last-mentioned bellcrank lever being attached to a second link reciprocated by a cam, characterized by an adjustable position connection provided between one of said links and its associated arm of said last-mentioned bellcrank lever whereby the stroke of said ejecting member is adjustable by adjustment of the position connection.

11. The improvement according to claim 10, wherein at least one said link is of adjustable length.

12. The improvement according to claim 10, said ejecting member comprising at least one suction nozzle characterized by said ejecting member being rotatably mounted on a support block which in turn is slidably mounted on a guide, said ejecting member being attached to said first link, a guide plate being associated with said ejecting member for controlling its angular orientation, a lug-and-slot type coupling connection being provided between said ejecting member and said guide plate.

13. The improvement according to claim 12, wherein said guide plate is adjustable in position.

14. The improvement according to claim 12, wherein said guide plate is removably mounted and adapted to be replaced by another guide plate of different characteristics.

* * * * *